United States Patent [19]

McCoy et al.

[11] Patent Number: 4,706,428

[45] Date of Patent: Nov. 17, 1987

[54] APPARATUS FOR REINFORCING A CONCRETE BLOCK WALL

[76] Inventors: Donald M. McCoy, 10016 N. Krikland Ct.; James M. McCoy, 11249 N. Oriole Ln., both of Mequon, Wis. 53092

[21] Appl. No.: 920,523

[22] Filed: Oct. 17, 1986

[51] Int. Cl.[4] ..... E04B 2/16; E02D 27/00

[52] U.S. Cl. ..... 52/293; 52/295

[58] Field of Search ..... 52/23, 293, 294, 295, 52/562, 225, 229, 292

[56] References Cited

U.S. PATENT DOCUMENTS

| | | | |
|---|---|---|---|
| 377,940 | 2/1888 | Hevner . | |
| 573,452 | 12/1896 | Delahunt | 52/92 |
| 1,056,810 | 3/1913 | McDonald | 52/293 |
| 1,647,925 | 11/1927 | May | 52/294 |
| 2,179,407 | 11/1939 | Flores | 52/293 |
| 2,414,628 | 1/1947 | Battin | 52/293 |
| 2,605,865 | 8/1952 | Liptay | 52/292 |
| 2,635,451 | 4/1953 | Walters | 52/293 |
| 2,684,589 | 7/1954 | Perreton | 52/293 |
| 2,815,656 | 12/1957 | Klein | 52/293 |
| 3,036,407 | 5/1962 | Dixon | 52/293 |
| 3,330,084 | 7/1967 | Russell | 52/92 |
| 3,430,397 | 3/1969 | Ellis . | |
| 3,537,220 | 11/1970 | Ellis . | |
| 3,662,507 | 5/1972 | Espeland | 52/293 |
| 4,015,399 | 4/1977 | Prins | 52/92 |
| 4,059,931 | 11/1977 | Mongan . | |
| 4,563,852 | 1/1980 | Achtenberg | 52/293 |

*Primary Examiner*—John E. Murtagh

*Attorney, Agent, or Firm*—Andrus, Sceales, Starke & Sawall

[57] ABSTRACT

An apparatus for reinforcing a concrete block wall includes an elongated reinforcing member, an upper retainer plate, and an anchor plate disposed in the block wall above the foundation. A threaded portion is provided at the upper end of the reinforcing member, to introduce tension into the reinforcing member after connection to the lower anchor plate and the upper retainer plate. The upper retainer plate is provided with a bracing means for bracing the top of the wall against lateral movement.

8 Claims, 7 Drawing Figures

APPARATUS FOR REINFORCING A CONCRETE BLOCK WALL

BACKGROUND OF THE INVENTION

This invention relates to the repair or reinforcing of foundation walls, and more particularly to an apparatus for reinforcing foundation walls constructed of hollow concrete blocks.

The foundation walls of residential buildings are commonly constructed of hollow concrete blocks stacked in courses and bonded together by mortar. Such a construction generally provides a foundation wall which is relatively inexpensive and simple to construct. However, a drawback of the concrete block construction is that the wall has relatively little strength to resist lateral forces, such as forces resulting from hydrostatic pressure or from backfilling of the wall. It is not unusual for a concrete block foundation wall to yield to such lateral forces, thereby causing the wall to fail at the mortar joints. These failures result in cracks which can cause water seepage and inflow into the basement area. In extreme cases, the wall may fail completely as a result of lateral forces, thus causing extensive damage to the foundation structure as well as to the overlying building.

Previous solutions to overcome the above-described problems include U.S. Pat. No. 4,563,852 to Achtenberg et al. This patent is directed to a reinforcing method in which an elongated reinforcing member is secured within a passage in the wall, and the passage is then filled with concrete. The reinforcing member is connected at its lower end to an anchor bolt secured to the concrete foundation by an expansion anchor. Such a connection to the concrete foundation is disadvantageous in that it is difficult to drill a hole in the concrete through the relatively small access opening provided. Further, the reinforcing method shown in the noted patent calls for substantial work to be performed inside the wall itself, which necessitates a slow and difficult installation procedure due to the small space within which to work.

Other reinforcing methods and apparatus have been developed for concrete block walls. However, most such apparatus and methods provide an external bracing system, which detracts from the aesthetic appearance of the wall.

A need thus exists for a reinforcing apparatus which can be installed with a minimum of work inside the block wall. A further need exists for a reinforcing apparatus which can effectively strengthen a concrete block wall without the need for an anchor to the concrete foundation. A further need exists for a reinforcing apparatus which has a minimal amount of external componentry which detracts from the appearance of the wall.

SUMMARY OF THE INVENTION

The invention was developed in response to the above needs. In accordance with one aspect of the invention an apparatus for reinforcing a concrete block wall is provided with an elongated reinforcing member for placement within a vertical passage of the wall.

In accordance with another aspect of the invention the lower end of the reinforcing member is anchored to a lower anchor means disposed above the concrete foundation.

In accordance with yet another aspect of the invention a retainer means is provided adjacent the upper surface of the wall for maintaining the upper end of the reinforcing member in position.

In accordance with yet another aspect of the invention a tensioning means is provided for introducing tension into the reinforcing member after it has been anchored to the lower anchor means and connected to the retainer means.

The present invention thus provides an apparatus for reinforcing a concrete block wall which operates independent of any connection of the reinforcing member to the concrete foundation. The apparatus of the present invention further has a majority of its components located either inside or on top of the wall, which provides relatively quick and easy installation of the apparatus. Such location of the components of the apparatus also interferes very little with the external appearance of the wall or with further finishing of the wall.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
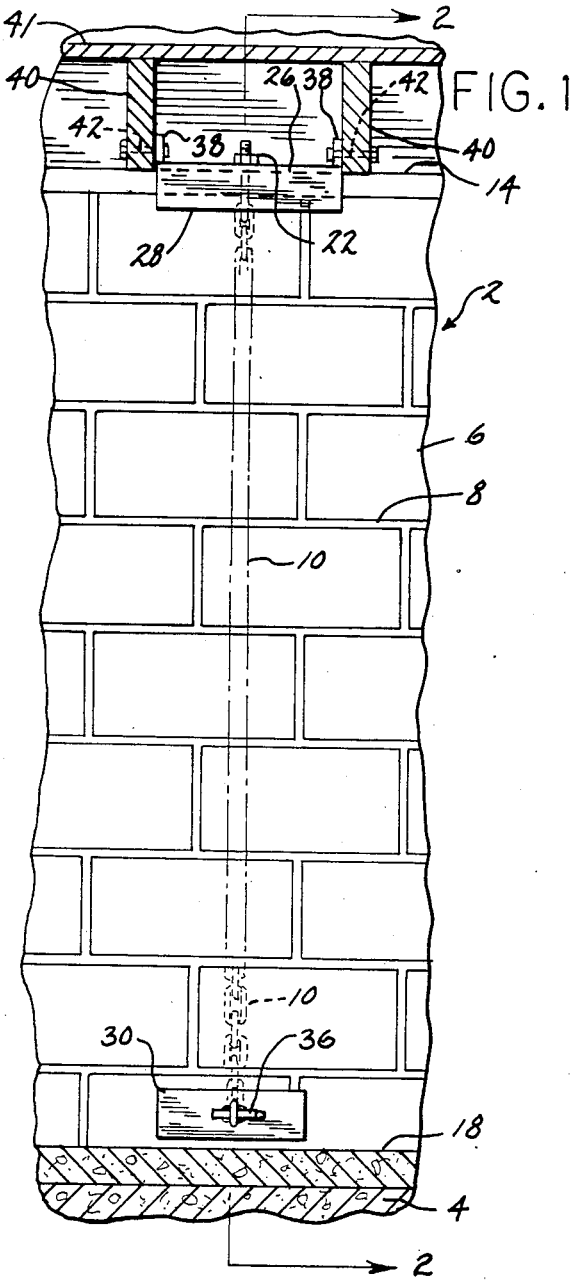
FIG. 1 is an elevation view of a concrete block foundation wall provided with the reinforcing apparatus of the present invention.

As shown in FIG. 1 a foundation wall 2 is erected on a concrete foundation 4. A concrete floor slab 18 abuts the inside face of wall 2 adjacent to foundation 4.

Wall 2 is constructed of consecutive courses of concrete blocks 6 bonded together by mortar joints 8. The concrete blocks 6 are of the hollow type, meaning that each block is provided with two or more internal vertical passages formed by vertical side walls extending through the block. Blocks 6 are generally stacked in courses, so that the vertical passages in the blocks cooperate to form a series of generally vertical passages in the wall.

A top plate 14 is provided on top of wall 2. Joists 40 are installed at even intervals above top plate 14, which support an overlying floor 41.

Figure 2:
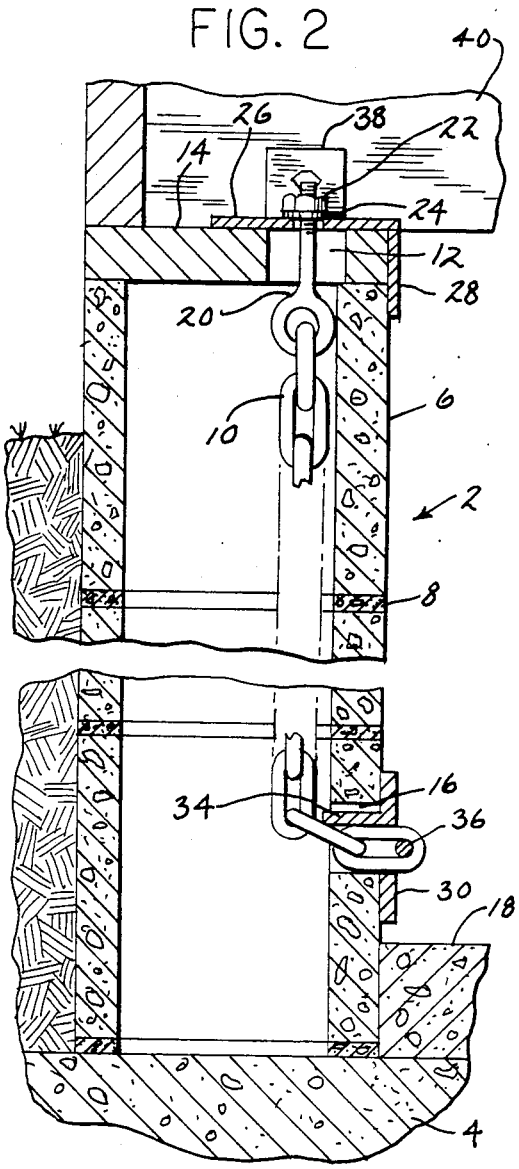
FIG. 2 is a cross-sectional view of the wall and reinforcing apparatus of FIG. 1, taken generally along line 2—2 of FIG. 1.
Figure 3:
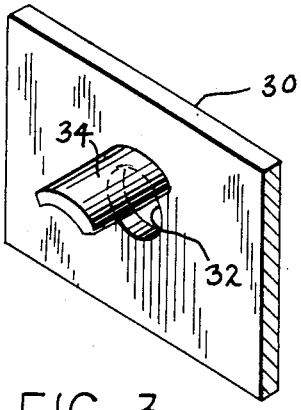
FIG. 3 is a perspective view of one embodiment of the lower anchor means of the reinforcing apparatus of FIG. 1.

Referring now to FIGS. 1 and 2, wall 2 is provided with an elongated reinforcing member, such as a link chain 10, within one of the generally vertical passages of wall 2. Chain 10 is connected at its upper end to an eye bolt 20, which has a threaded portion projecting from the top of wall 2 through an opening 12 provided in top plate 14. Eye bolt 20 is provided with a cooperating nut 22 and washer 24.

An opening 16 is provided in the face of wall 2 in the block against which floor slab 18 abuts. Opening 16 is in line with chain 10, so that the lower end of chain 10 may be drawn therethrough.

Figure 4:
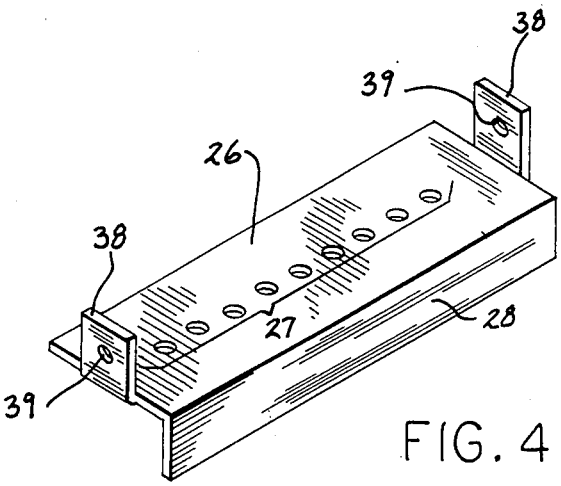
FIG. 4 is a perspective view of one embodiment of the upper retainer means of the reinforcing apparatus of FIG. 1.

A retainer plate 26 is provided on top of the top plate 14, between a pair of joists 40, for maintaining the upper end of chain 10 in position. Retainer plate 26 has a lip 28 extending downwardly therefrom and abutting the face of wall 2. Lip 28 acts as a bracing means to prevent lateral movement at the top of wall 2, as will be explained. As shown in FIG. 4, retainer plate 26 has a series of openings 27 along its length. The shaft of eye bolt 20 passes through one of the openings 27, to allow the threaded portion of eye bolt 20 to project above top plate 14. The series of openings 27 is necessary because the precise location of the vertical passage in wall 2 through which chain 10 passes, in relation to joists 40, is unknown prior to installation. Providing a series of openings 27 thus eliminates the need for field locating and placing of such opening.

As shown in FIG. 4, retainer plate 26 has an upstanding ear 38 at each of its ends, with each ear 38 having a hole 39 therein. Ears 38 form another part of the bracing means for preventing lateral movement at the top of wall 2. When retainer plate 26 is placed between the pair of joists 40, as shown in FIG. 1, one ear 38 is adjacent each joist. Ears 38 are connected to joists 40 through holes 39 by bolt/nut assemblies 42.

A lower anchor plate 30 is provided at opening 16 in the face of wall 2. Lower anchor plate 30 has a hole 32 adapted to fit over opening 16. A laterally-extending projection 34 is provided adjacent the upper edge of hole 32. Projection 34 is adapted to be inserted through opening 16 in wall 2 for guiding chain 10 through opening 16, and for preventing chain 10 from bearing on the portion of wall 2 above opening 16. A pin 36 is provided for anchoring chain 10 to lower anchor plate 30.

To install the reinforcing apparatus of the invention, upper opening 12 is first formed in top plate 14 in line with a vertical passage in wall 2. Lower opening 16 is then formed in wall 2 in line with the vertical passage and upper opening 12. Eye bolt 20 is then attached to the upper end of chain 10 through the topmost link of chain 10. Chain 10 is inserted through opening 12 provided in top plate 14 and fed down through the vertical passage in wall 2. A hook or the like is inserted through opening 16 to locate the lower end of chain 10 and to draw chain 10 through opening 16. The shaft of eye bolt 20 is then passed through the appropriate opening in top retainer plate 26, and the nut 22 and washer 24 are installed on the threaded portion of the shaft of eye bolt 20. Retainer plate 26 is then positioned on wall 2 and connected to joists 40, and lower anchor plate 30 is positioned over opening 16. Pin 36 is inserted through the link of chain 10 protruding through plate 30, in order to anchor chain 10 to anchor plate 30.

The threaded portion of eye bolt 20 projecting above retainer plate 26 provides a means for varying the length of such projection. To achieve its reinforcing function, tension is introduced into the reinforcing apparatus of the invention by turning nut 22 down against retainer plate 26. This action extends the length of the projection of eye bolt 20 above retainer plate 26, which induces upward movement in chain 10 to draw the protruding link at the lower end of chain 10 inward. This inward movement is prevented by pin 36, which thereby anchors chain 10 to lower anchor plate 30 and allows tension to be introduced in chain 10. Projection 34 on lower anchor plate 30 prevents chain 10 from bearing on the portion of block above opening 16 when tension is introduced in chain 10.

The introduction of tension into the reinforcing member acts to stiffen and reinforce the concrete block wall. This reinforcing takes place without the need for filling of the vertical passage with concrete after installation of the reinforcing apparatus, thus eliminating a costly and time-consuming step in the typical reinforcing of such walls.

Lateral movement at the top of wall 2 is prevented by the bracing means provided by the connection of retainer plate 26 to joists 40, acting in cooperation with downwardly extending lip 28 provided on retainer plate 26. Lateral movement at the bottom of wall 2 is prevented by floor slab 18 due to the placement of opening 16 in the block adjacent slab 18.

Figure 5:
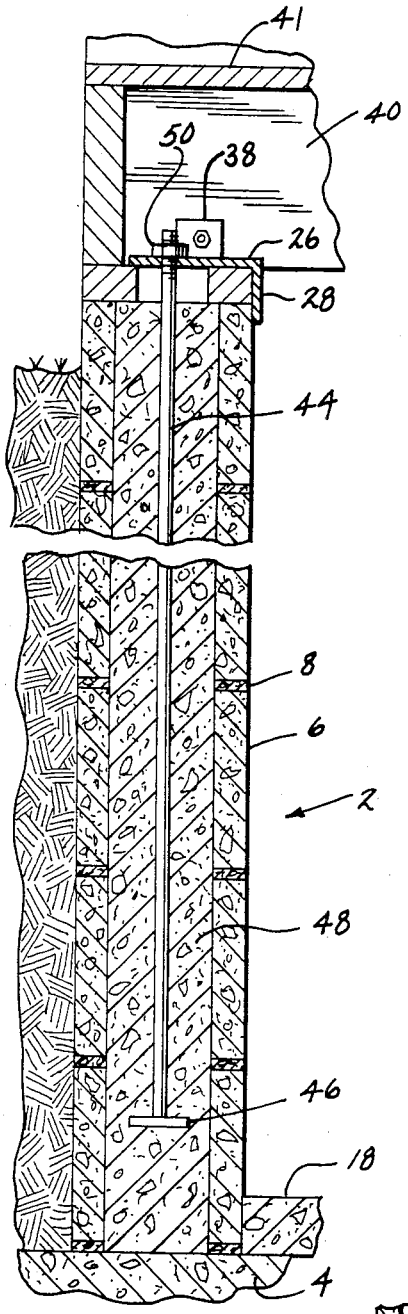
FIG. 5 is a cross-sectional view similar to FIG. 2, showing a second embodiment of the reinforcing apparatus of the present invention.

FIG. 5 shows another embodiment of the invention. This embodiment is provided with the same top connection detail as previously described, namely a top retainer plate 26 having a pair of ears 38 and a downwardly extending lip 28. In this embodiment, a reinforcing member 44 is provided with a lower anchor 46 at its lower end. Reinforcing member 44 has a threaded portion at its upper end, which projects above retainer plate 26. The threaded portion of reinforcing member 44 is provided with a cooperating nut 50.

Anchor 46 is connected to reinforcing member 44 so as to be substantially horizontal. After reinforcing member 44 and anchor 46 are positioned within wall 2 the vertical passage within which they are placed is filled with concrete 48. Prior to filling the passage with concrete, however, reinforcing member 44 must be lubricated or encased in order to prevent the concrete from bonding to its surface. Retainer plate 26 is positioned over reinforcing member 44 after the concrete 48 is in place, and ears 38 are connected to joists 40. Nut 50 is then installed on the threaded portion of reinforcing member 44.

After the column of concrete formed by filling the vertical passage has cured, nut 50 is turned down on retainer plate 26 to extend the length of the projection of reinforcing member 44 above retainer plate 26, as previously described. In this manner, tension is introduced into reinforcing member 44 to reinforce wall 2.

This embodiment of the invention provides a reinforcing apparatus which again eliminates the need for connection to the concrete foundation 4. This embodiment eliminates entirely the formation of any openings or passages in the face of wall 2, thereby preserving the aesthetic integrity of the wall.

Figure 6:
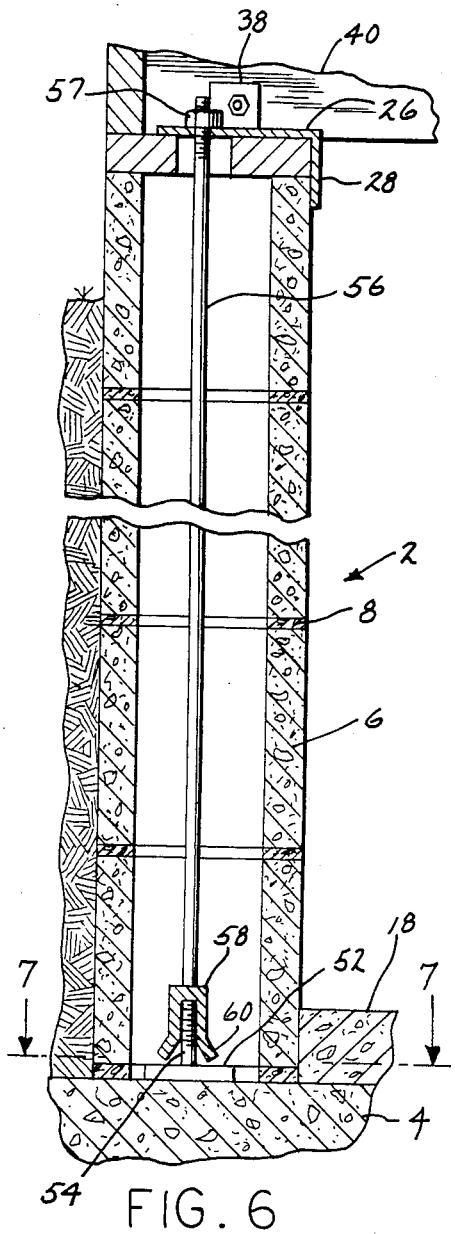
FIG. 6 is a cross-sectional view similar to FIG. 2, showing a third embodiment of the reinforcing apparatus of the present invention.

Yet another embodiment of the invention is shown in FIG. 6. This embodiment has the same top connection detail previously described. In this embodiment, an anchor plate 52 is provided on top of concrete foundation 4. This placement of anchor plate 52 is performed during the initial construction of wall 2. Alternatively, this embodiment may be used to reinforce an existing block wall by forming a horizontal slot in the face of wall 2 adjacent to floor slab 18, into which plate 52 is inserted.

Anchor plate 52 is provided with an upstanding threaded stud 54, which projects upwardly into one of the generally vertical passages within wall 2. A reinforcing member 56 is provided within the same passage, extending downwardly from the top of wall 2. Reinforcing member 56 has a threaded portion at its upper end, which projects above retainer plate 26. The threaded portion of reinforcing member 56 is provided with a cooperating nut 57. Reinforcing member 56 is provided at its lower end with a female threaded portion 58, which is adapted to mate with stud 54. Reinforcing member 56 is inserted at the top of wall 2 and fed downwardly, and female threaded portion 58 is then mated with stud 54. A diverging flange 60 is provided on female threaded portion 58 for guiding stud 54 into the female threads.

Figure 7:
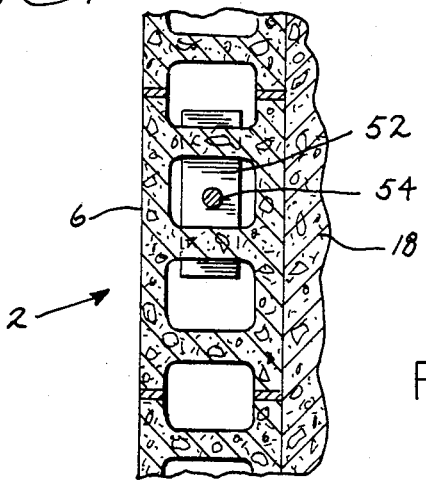
FIG. 7 is a plan view of the lower anchor means of the reinforcing apparatus of FIG. 6, taken generally along line 7—7 of FIG. 6.

As shown in FIG. 7, anchor plate 52 extends horizontally within and along wall 2 beyond the vertical passage into which stud 54 projects. In this manner, a portion of plate 52 rests below the bottom portions of the vertical side walls forming the vertical passage. When nut 57 is turned down onto retainer plate 26, upward movement is induced in reinforcing member 56 by extending the length of the projection of reinforcing member 56 above retainer plate 26, as previously described. Such upward movement is prevented by the bearing of plate 52 against the bottom portions of the vertical side walls, thereby causing tension to be introduced into reinforcing member 56. In this embodiment, the step of filling the vertical passage with concrete is again eliminated.

Various modes of carrying out the invention are contemplated as being within the scope of the following claims particularly pointing out and distinctly claiming the subject matter which is regarded as the invention.

We claim:

1. In a block wall erected on a foundation and being formed of consecutive courses of blocks having vertical passages therein formed by vertical side walls in the concrete block, so that the blocks cooperate to form a series of generally vertical passages in the wall, an apparatus for reinforcing said wall, comprising:

an elongated reinforcing member for placement within at least one of the vertical passages of the wall, said reinforcing member having an upper end and a lower end;

anchor means for anchoring said lower end of said reinforcing member, said anchor means being disposed exteriorly of a face of the wall at a point adjacent the bottom of the wall above the top of the foundation independent of any connection to the foundation;

retainer means for maintaining said upper end of said reinforcing member in position, said retainer means being adjacent the upper surface of the wall and connected to said upper end of said reinforcing member; and tensioning means for introducing tension into said reinforcing member after said reinforcing member is anchored to said anchor means and connected to said retainer means to reinforce said wall, whereby said anchor means prevents upward movement of said reinforcing member when tension is introduced into said reinforcing member by use of said tensioning means, independent of any connection of said reinforcing member to the foundation.

2. The reinforcing apparatus of claim 1, wherein said retainer means includes bracing means for bracing the top of said wall against lateral movement.

3. The reinforcing apparatus of claim 2, wherein a series of joists is disposed above the wall, and wherein said retainer means comprises a plate for placement between a pair of said joists, and said bracing means includes connection means for providing a fixed connection of said plate to said pair of joists and for preventing lateral movement of said plate relative to said joists, and a lip extending downwardly from said plate, said lip abutting a face of the wall, to thereby cooperate with said connection means for bracing the top of the wall against lateral movement.

4. The reinforcing apparatus of claim 3, wherein said plate has an end adjacent each of said pair of joists, and said connection means for providing a connection of said plate to said pair of joists and for preventing lateral movement of said plate relative to said joists comprises an upstanding ear disposed at each said end of said plate and means for fastening said ears to said joists for preventing lateral movement of said plate relative to said joists.

5. The reinforcing apparatus of claim 1, wherein said anchor means is disposed adjacent an opening provided in a face of the wall, said opening being disposed in the wall above the foundation, and wherein said reinforcing member is flexible and said lower end of said reinforcing member protrudes from said opening in the face of the wall and is anchored to said anchor means.

6. The reinforcing apparatus of claim 5, wherein said tensioning means comprises a rigid member connected to said upper end of said flexible reinforcing member, said rigid member having a portion projecting above said retainer means and being provided with means for maintaining said projection in position and for varying the length of said projection above said retainer means, so that extending the length of said projection above said retainer means introduces tension into said reinforcing member after said lower end of said reinforcing member is anchored to said anchor means.

7. The reinforcing apparatus of claim 5, wherein said lower anchor means comprises a plate provided with a hole adapted to fit over said opening in the wall, said hole being in substantial alignment with said opening, and wherein said lower end of said reinforcing member extends through said opening in the wall and through said hole in said plate, and is provided with a pin connected transversely to said reinforcing member adjacent said plate to prevent said reinforcing member from moving inward through said hole, so that when tension is provided in said reinforcing member an inward movement is produced in said protruding lower end of said reinforcing member, to thereby draw said pin tight against said plate to anchor said lower end of said reinforcing member to said plate.

8. The reinforcing apparatus of claim 5, wherein said anchor means includes a laterally extending projection adjacent the upper edge of said hole in said plate adapted to be inserted through said opening in the face of the wall, for guiding said reinforcing member through said opening in the wall and for preventing said reinforcing member from bearing on the portion of block adjacent said opening.

* * * * *